US009634380B2

(12) United States Patent
Kato

(10) Patent No.: US 9,634,380 B2
(45) Date of Patent: Apr. 25, 2017

(54) ANTENNA DEVICE AND COMMUNICATION TERMINAL DEVICE

(71) Applicant: Murata Manufacturing Co., Ltd., Nagaokakyo-shi, Kyoto-fu (JP)

(72) Inventor: Noboru Kato, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 125 days.

(21) Appl. No.: 14/594,268

(22) Filed: Jan. 12, 2015

(65) Prior Publication Data

US 2015/0123858 A1 May 7, 2015

Related U.S. Application Data

(63) Continuation of application No. PCT/JP2014/064665, filed on Jun. 3, 2014.

(30) Foreign Application Priority Data

Jun. 14, 2013 (JP) ..... 2013-125185

(51) Int. Cl.
*H01Q 1/24* (2006.01)
*H01Q 7/00* (2006.01)
(Continued)

(52) U.S. Cl.
CPC ..... *H01Q 1/243* (2013.01); *H01Q 7/00* (2013.01); *H01Q 7/08* (2013.01); *H01Q 9/0421* (2013.01); *H01Q 9/42* (2013.01); *H01Q 21/28* (2013.01)

(58) Field of Classification Search
CPC ..... H01Q 1/243; H01Q 7/00; H01Q 7/08; H01Q 1/2208
(Continued)

(56) References Cited

U.S. PATENT DOCUMENTS 7,280,076 B2 * 10/2007 Ninomiya ..... G06K 7/0008 343/702
2002/0135522 A1 9/2002 Yamamoto et al.
(Continued)

FOREIGN PATENT DOCUMENTS

EP 2 733 787 A1 5/2014
JP 11-112226 A 4/1999
(Continued)

OTHER PUBLICATIONS

Official Communication issued in corresponding European Patent Application No. 14810308.8, mailed on Oct. 19, 2015.
(Continued)

*Primary Examiner* — Dieu H Duong
(74) *Attorney, Agent, or Firm* — Keating & Bennett, LLP

(57) ABSTRACT

An antenna device includes two conductor surfaces facing each other and spaced apart from each other, connecting conductors that connect the two conductor surfaces at at least two positions, and an antenna coil located in proximity to one of the connecting conductors. The connecting conductors and the two conductor surfaces define a closed loop containing a surface of a space. In a plan view of the surface of the space defined by the closed loop, the antenna coil is located at a position where the antenna coil does not overlap the surface of the space and at a position where electromagnetic induction by the antenna coil causes an induced current to flow through the connecting conductor.

20 Claims, 8 Drawing Sheets

(51) Int. Cl.

| | |
|---|---|
| ***H01Q 7/08*** | (2006.01) |
| ***H01Q 9/04*** | (2006.01) |
| ***H01Q 9/42*** | (2006.01) |
| ***H01Q 21/28*** | (2006.01) |

(58) Field of Classification Search
USPC ..... 343/788, 702, 866, 741
See application file for complete search history.

(56) References Cited

U.S. PATENT DOCUMENTS

| | | | | |
|---|---|---|---|---|
| 2010/0048265 | A1* | 2/2010 | Chiang | H01Q 1/243 455/575.7 |
| 2012/0214412 | A1* | 8/2012 | Schlub | G01B 7/023 455/41.1 |
| 2015/0070224 | A1 | 3/2015 | Nakano | |
| 2016/0156104 | A1 | 6/2016 | Nakano et al. | |

FOREIGN PATENT DOCUMENTS

| | | | | |
|---|---|---|---|---|
| JP | 2010028351 | A | * | 2/2010 |
| JP | 4993045 | B2 | | 8/2012 |
| JP | 2013-55637 | A | | 3/2013 |
| WO | 2012/173080 | A1 | | 12/2012 |

OTHER PUBLICATIONS

Official Communication issued in International Patent Application No. PCT/JP2014/064665, mailed on Aug. 5, 2014.
Official Communication issued in corresponding European Patent Application No. 14 810 308.8, mailed on Jul. 4, 2016.

* cited by examiner

ANTENNA DEVICE AND COMMUNICATION TERMINAL DEVICE

BACKGROUND OF THE INVENTION

1. Field of the Invention

The present invention relates to an antenna device and a communication terminal device that are preferably used for a communication system for the HF band and the UHF band.

2. Description of the Related Art

Among devices provided for electronic devices such as mobile phones and that perform HF band communication such as near field communication (NFC), an RFIC and a matching element are generally mounted on a circuit board, and an antenna is attached to an inner surface of an enclosure of an electronic device. The RFIC and the antenna are electrically connected to each other through spring pins or the like.

Meanwhile, wireless communication terminals such as recent mobile phones have been made increasingly thinner. To compensate for insufficient strength caused by such reduction in thickness, there are more cases than before where an enclosure is "metallized" such as a case where an enclosure is plated with magnesium.

However, in the case where an enclosure of a terminal is "metallized", there arises a problem in which communication with a counterpart antenna is prevented, because an electromagnetic field around an antenna incorporated in the terminal is shielded by a metal.

Hence, as disclosed in Japanese Patent No. 4993045, there is proposed an antenna device having a configuration in which a metal plate having a larger area than an antenna coil is located in proximity to the antenna coil (to induce magnetic field coupling) so as to use the metal plate as a radiator.

The antenna configuration described in Japanese Patent No. 4993045 enables communication with a counterpart antenna, despite the antenna being covered with a metal. However, in a case where the metal plate is provided with a slit or an opening portion, consideration of decreased mechanical strength is required, and thus the number of man-hours required for production is increased. In addition, particularly in a case where a metal enclosure is provided with a slit or an opening, there arises a restriction on enclosure design. Further, since a portion in the vicinity of the slit or the opening portion cannot be connected to the ground of a circuit, portions of the metal plate might have a variation in potential. This causes a problem in which a field shield effect due to use of the metal plate is deteriorated, and a concern in which a first conductor surface and a second conductor surface might interfere with another radio frequency circuit.

SUMMARY OF THE INVENTION

Preferred embodiments of the present invention provide an antenna device in which, by making a conductor surface, such as a metal plate, usable as a radiating element without providing the metal plate with a slit or an opening, a problem of decreased mechanical strength, a problem of design restriction, and a problem of deteriorated field shield effect are avoided, and further in which a problem of interference with another radio frequency circuit or other problem is prevented as necessary, and provide a communication terminal device including the antenna device.

An antenna device according to a preferred embodiment of the present invention includes two conductor surfaces arranged to face each other and be spaced apart from each other, a plurality of connecting conductors that connect the two conductor surfaces at at least two positions, and an antenna coil located in proximity to at least one of the plurality of connecting conductors.

Two of the plurality of connecting conductors and the two conductor surfaces define a closed loop containing a surface of a space. In a plan view of the surface of the space defined by the closed loop, the antenna coil is located at a position where the antenna coil does not overlap the surface of the space and at a position where electromagnetic induction by the antenna coil causes an induced current to flow through the connecting conductor.

With this configuration, the induced current caused by the electromagnetic induction by the antenna coil flows through the connecting conductor in proximity to which the antenna coil is located, and thus the current flows through the two conductor surfaces. Accordingly, the two conductor surfaces define and function as a radiating element. The surface of the space of the closed loop also defines and functions as a radiating element.

It is preferable that the connecting conductors include three or more connecting conductors, and that in plan views of surfaces of spaces in a plurality of loops defined by two adjacent connecting conductors of the connecting conductors and the two conductor surfaces, the antenna coil is located at a position where the antenna coil does not overlap any one of the surfaces of the spaces. This configuration prevents cancellation between a magnetic field from the antenna coil and a magnetic field from each closed loop, the cancellation resulting from arrangement of the antenna coil in the closed loop.

The conductor surfaces preferably include a conductor portion of an enclosure of an electronic device. This configuration enables the enclosure to be used also as a portion of the radiating element.

It is preferable that the conductor surfaces include a ground electrode provided in a circuit board. This configuration enables the ground electrode in the circuit board to be used also as a portion of the radiating element.

It is preferable that the conductor surfaces include a ground electrode provided in a circuit board and a conductor portion of an enclosure of an electronic device, and that the connecting conductors are ground connecting pins that connect the ground electrode and the conductor portion of the enclosure. This configuration enables the ground connecting pins to be used also as the connecting conductors.

It is preferable that any one of the plurality of connecting conductors that does not define the closed loop and the conductor surfaces be connected to one another through a capacitor, that a carrier frequency of a communication signal is a frequency in the HF band, and that the capacitor is an element that has a low impedance at a frequency equal to or higher than the UHF band. A substrate current caused by an antenna for the UHF band located in the same enclosure is thus influenced by the antenna coil less easily, and thus the antenna for the UHF band achieves certain antenna characteristics.

A communication terminal device according to another preferred embodiment of the present invention includes an antenna device and a power supply circuit connected to the antenna device. The antenna device includes two conductor surfaces arranged to face each other and spaced apart from each other, a plurality of connecting conductors that connect the two conductor surfaces at at least two positions, and an antenna coil located in proximity to at least one of the plurality of connecting conductors. Two of the plurality of connecting conductors and the two conductor surfaces defining a closed loop containing a surface of a space. In a plan view of a surface of the space defined by the closed loop, the antenna coil is located at a position where the antenna coil does not overlap the surface of the space and at a position where electromagnetic induction by the antenna coil causes an induced current to flow through the connecting conductors.

According to various preferred embodiments of the present invention, the two conductor surfaces are preferably used as the radiating element without providing any of the conductor surfaces with a slit or an opening, and thus the problem of decreased mechanical strength, the problem of design restriction, and the problem of deteriorated field shield effect are prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
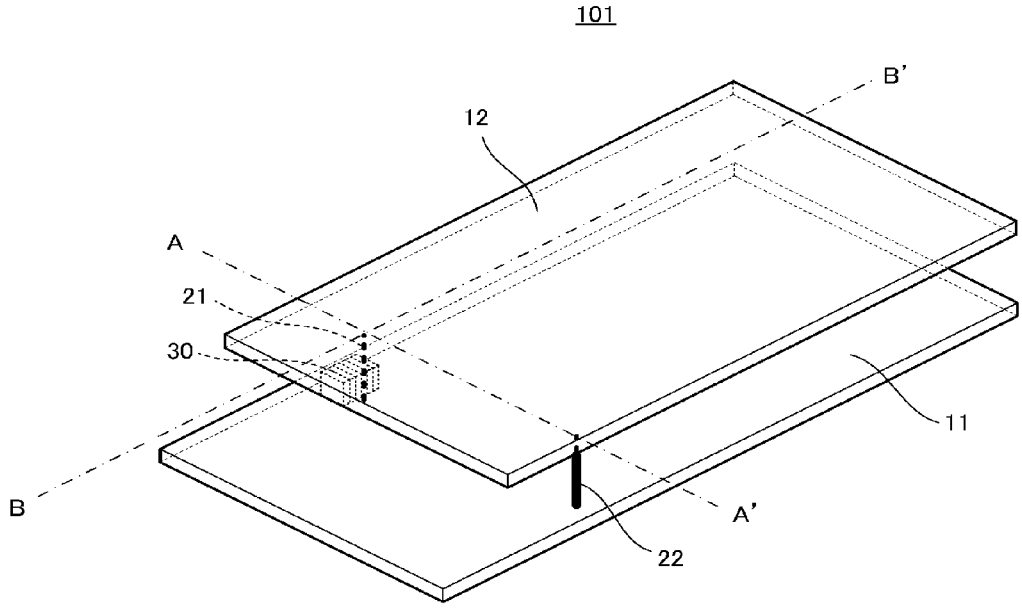
FIG. 1A is a perspective view of an antenna device 101 according to a first preferred embodiment of the present invention.

Hereinafter, a plurality of preferred embodiments for carrying out the present invention will be described with reference to the drawings and by providing specific examples. The same elements are denoted by the same reference numerals in the drawings. The preferred embodiments are provided for illustrative purposes. A configuration described in any one of the preferred embodiments can be partially replaced or combined with a configuration described in a different one of the preferred embodiments.

First Preferred Embodiment

Figure 1B:
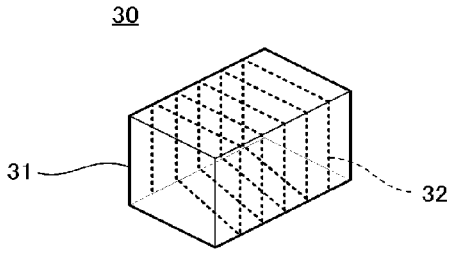
FIG. 1B is a perspective view of an antenna coil 30 provided for the antenna device 101.
Figure 2:
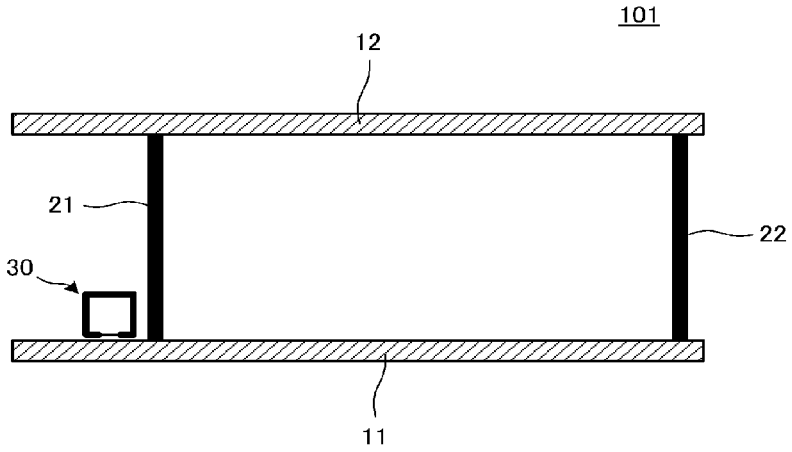
FIG. 2 is a cross-sectional view taken along the line A-A' in FIG. 1A.

FIG. 1A is a perspective view of an antenna device 101 according to a first preferred embodiment of the present invention, and FIG. 1B is a perspective view of an antenna coil provided for the antenna device 101. FIG. 2 is a cross-sectional view taken along the line A-A' in FIG. 1A. The antenna device 101 is preferably used for an HF band such as 13.56 MHz and is a proximity-type or vicinity-type antenna using electromagnetic (mainly magnetic) field coupling to a communication counterpart antenna, for example.

The antenna device 101 includes a first conductor surface 11 and a second conductor surface 12 that face each other and are spaced apart from each other. The first conductor surface 11 and the second conductor surface 12 are connected to each other through a first connecting conductor 21 and a second connecting conductor 22. The antenna coil 30 is located between the first conductor surface 11 and the second conductor surface 12 and in proximity to the first connecting conductor 21.

As illustrated in FIG. 1B, the antenna coil 30 includes a magnetic core 31 and a coil conductor 32. The coil conductor 32 is preferably wound around the magnetic core 31. For example, the antenna coil 30 preferably is a chip-type antenna including a rectangular or substantially rectangular helical coil conductor incorporated in a multilayer body in the following manner. Coil conductor patterns are provided on a plurality of resin sheets in which fillers formed of a ferrite material as a magnetic material are dispersed. The resin sheets are stacked, thermally compressed, and bonded to each other. The antenna coil 30 may be a chip-type antenna using a magnetic ferrite ceramic material as an element assembly, for example.

The antenna coil 30 is located in the vicinity of the first connecting conductor 21 such that a portion of the coil conductor 32 included in the antenna coil 30 is parallel or substantially parallel to the first connecting conductor 21, the portion being in proximity to the first connecting conductor 21.

The first conductor surface 11 is, for example, a ground electrode pattern in a circuit board. The second conductor surface 12 is, for example, a metal portion of an enclosure. The first connecting conductor 21 and the second connecting conductor 22 are spring pin terminals and electrically and directly connect the first conductor surface 11 and the second conductor surface 12. These pin terminals are each primarily a ground connection pin that causes the metal portion of the enclosure and the ground electrode in the circuit board to have the same potential, but in the present preferred embodiment, are also preferably used as current paths through which a current flows through the first conductor surface 11 and the second conductor surface 12, as will be described later.

Figure 3A:
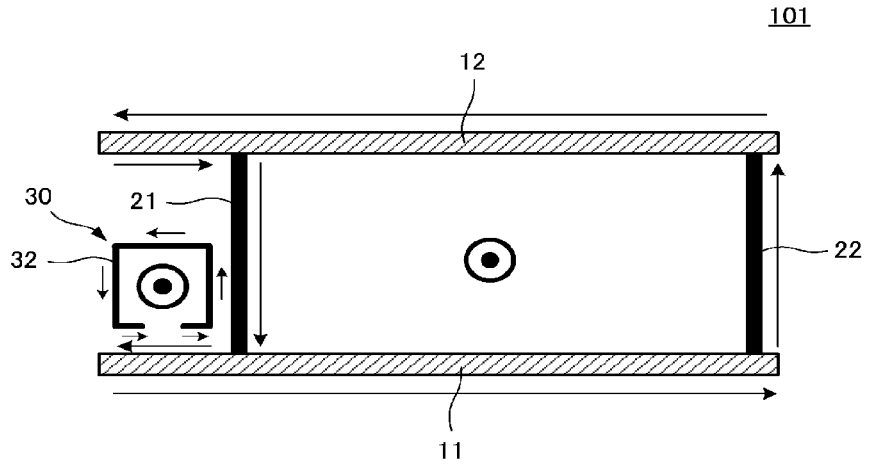
FIG. 3A is a front view illustrating a path of a current flowing through components of the antenna device 101.
Figure 3B:
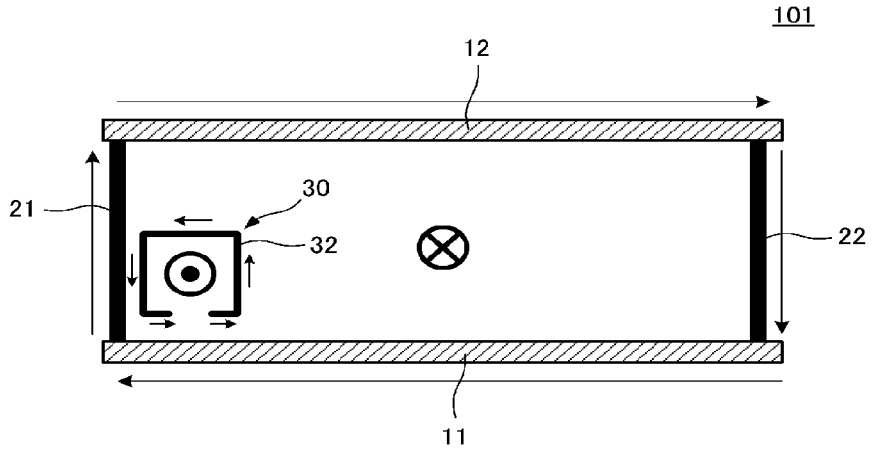
FIG. 3B is a front view illustrating a path of a current flowing through components of an antenna device in a comparative example.

FIG. 3A is a front view illustrating a path of a current flowing through components of the antenna device 101. FIG. 3B is a front view illustrating a path of a current flowing through components of an antenna device in a comparative example.

In the antenna device 101 in the present preferred embodiment, the two connecting conductors 21 and 22 and the two conductor surfaces 11 and 12 define a closed loop. In a plan view of a surface of a space in the closed loop, the antenna coil 30 is located at a position where the antenna coil 30 does not overlap the surface of the space, and is located at a position where electromagnetic induction by the coil conductor of the antenna coil 30 causes an induced current to flow through the first connecting conductor 21.

In the antenna device in the comparative example illustrated in FIG. 3B, the antenna coil 30 is located at a position where the antenna coil 30 overlaps a surface of a space in a closed loop. The electromagnetic induction by the antenna coil 30 causes the induced current to flow through the first connecting conductor 21.

In the case of the antenna device in the comparative example, as illustrated in FIG. 3B, proximity between the coil conductor 32 of the antenna coil 30 and the first connecting conductor 21 causes inductive coupling between the first connecting conductor 21 and the portion, of the coil conductor 32, in proximity to the first connecting conductor 21. Specifically, in a direction opposite to a direction in which a current flows through the coil conductor 32 of the antenna coil 30, the induced current flows through the first connecting conductor 21. The current circulates through the closed loop, taking a route of the second conductor surface 12, the second connecting conductor 22, the first conductor surface 11, and the first connecting conductor 21. The direction (polarity) of a magnetic field generated by flow of the current through the closed loop is opposite to the direction of a magnetic field generated by flow of the current through the antenna coil 30. For this reason, the magnetic fields are cancelled out, and the antenna device does not function as an antenna in actuality.

In contrast, in a case of the antenna device 101 in the present preferred embodiment, in a direction opposite to the direction in which the current flows through the coil conductor 32 of the antenna coil 30, an induced current flows through the first connecting conductor 21, as illustrated in FIG. 3A. The current circulates through the closed loop, taking a route of the first conductor surface 11, the second connecting conductor 22, the second conductor surface 12, and the first connecting conductor 21. The direction of a magnetic field generated by flow of the current through the closed loop is the same as the direction of a magnetic field generated by flow of the current through the antenna coil 30. For this reason, the first conductor surface 11, the second conductor surface 12, the first connecting conductor 21, and the second connecting conductor 22 that define the closed loop define and function as a booster antenna. The booster antenna and the antenna coil 30 defining and functioning as a power supply coil also define and function as an antenna device.

Figure 4A:
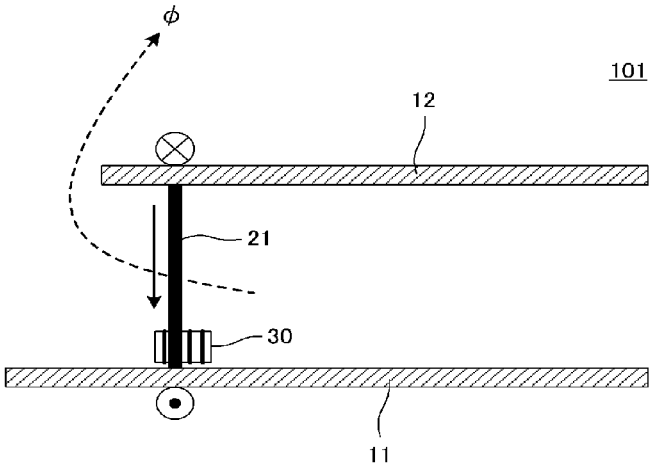
FIG. 4A is a cross-sectional view taken along the line B-B' in FIG. 1A and is a schematic view of a radiated magnetic flux.
Figure 4B:
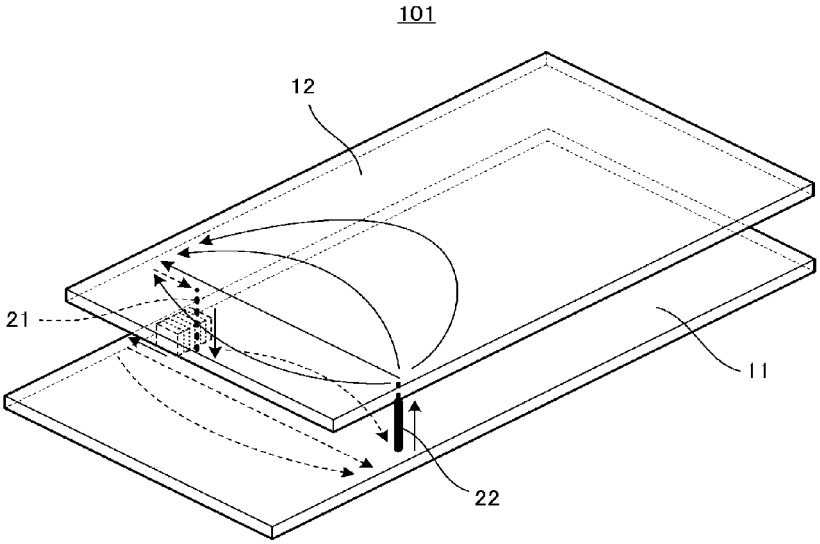
FIG. 4B is a perspective view illustrating paths of currents flowing through the antenna device 101.

FIG. 4A is a cross-sectional view taken along the line B-B' in FIG. 1A, and is a schematic view of a radiated magnetic flux. FIG. 4B is a perspective view illustrating paths of currents flowing through the antenna device 101. As illustrated in FIGS. 4A and 4B, when a current flows through the first conductor surface 11 and the second conductor surface 12, a magnetic field is generated which causes a magnetic flux $\phi$ to pass through the closed loop defined by the first conductor surface 11, the second conductor surface 12, the first connecting conductor 21, and the second connecting conductor 22 (refer to FIG. 2). Communication is performed by using a linkage of the magnetic flux $\phi$ with a communication counterpart antenna coil. The antenna device 101 preferably is used, for example, as an antenna for NFC communication using a 13.56 MHz frequency.

Figure 5:
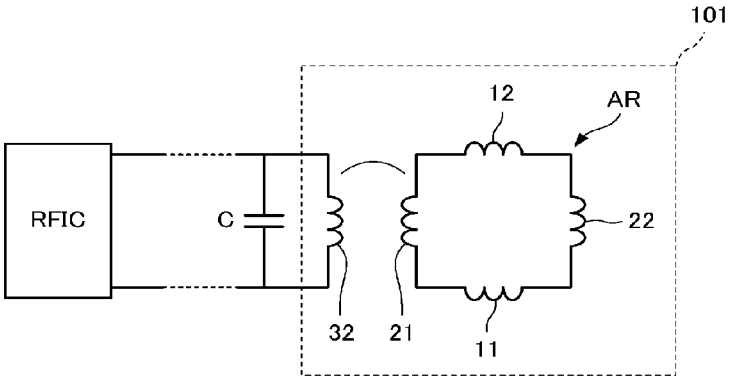
FIG. 5 is a circuit diagram of a wireless communication circuit including the antenna device 101.

FIG. 5 is a circuit diagram of a wireless communication circuit including the antenna device 101. In FIG. 5, a closed loop AR defined by the first conductor surface 11, the second conductor surface 12, the first connecting conductor 21, and the second connecting conductor 22 is represented by a closed loop circuit of an inductor. The coil conductor 32 of the antenna coil 30 is inductively coupled to the first connecting conductor 21. A radio frequency IC (RFIC) is connected to the coil conductor 32, and a resonant capacitor C is also connected to the coil conductor 32 in parallel. The capacitance of the capacitor C and the inductance of the coil conductor 32 are set so that a frequency of resonance between the capacitor C and the coil conductor 32 can be or can be close to a carrier frequency of communication signals.

Second Preferred Embodiment

Figure 6:
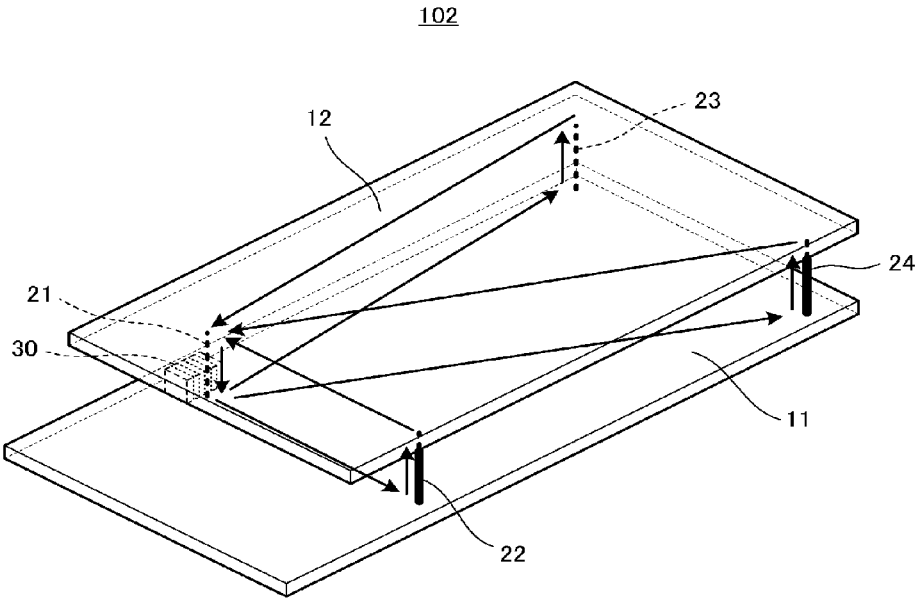
FIG. 6 is a perspective view of an antenna device 102 according to a second preferred embodiment of the present invention.

FIG. 6 is a perspective view of an antenna device 102 according to a second preferred embodiment of the present invention. The antenna device 102 includes the first conductor surface 11 and the second conductor surface 12 that face each other. The first conductor surface 11 and the second conductor surface 12 are connected to each other through the first connecting conductor 21, the second connecting conductor 22, a third connecting conductor 23, and a fourth connecting conductor 24. The antenna coil 30 is located between the first conductor surface 11 and the second conductor surface 12 and in proximity to the first connecting conductor 21. In an example illustrated in FIG. 6, the connecting conductors 21 and 22 and the conductor surfaces 11 and 12 define a closed loop, the connecting conductors 21 and 23 and the conductor surfaces 11 and 12 define a closed loop, and the connecting conductors 21 and 24 and the conductor surfaces 11 and 12 define a closed loop. The antenna coil 30 is located at a position where the antenna coil 30 does not overlap any one of surfaces of spaces in the closed loops. For this reason, the first conductor surface 11, the second conductor surface 12, and the connecting conductors 21, 22, 23, and 24 define and function as a booster antenna such that magnetic fluxes flow through these respective closed loops.

As described in the present preferred embodiment, a ground electrode in a substrate and a metal portion of an enclosure can be used such that currents flow not only in a direction of short sides of the ground electrode in the substrate and the metal portion of the enclosure, but also in a direction of long sides of the ground electrode and the metal portion.

Third Preferred Embodiment

Figure 7A:
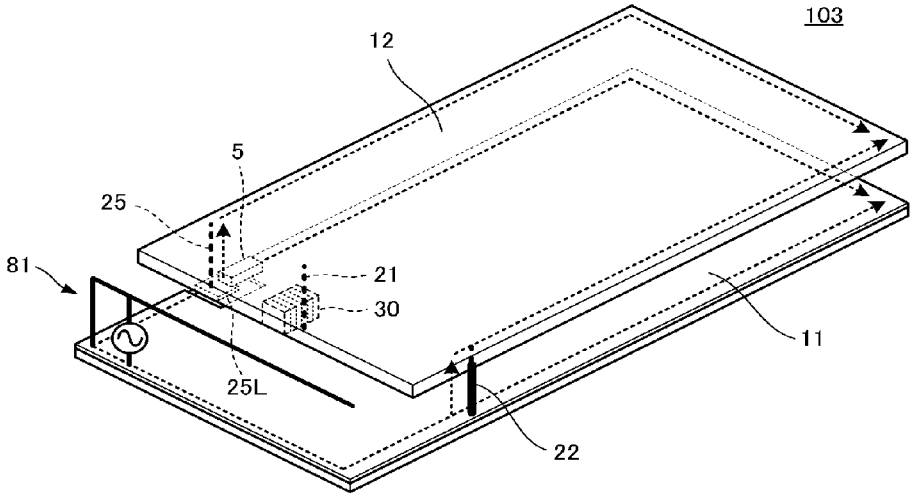
FIG. 7A is a perspective view of a portion of a communication terminal device including an antenna device 103 according to a third preferred embodiment of the present invention.
Figure 7B:
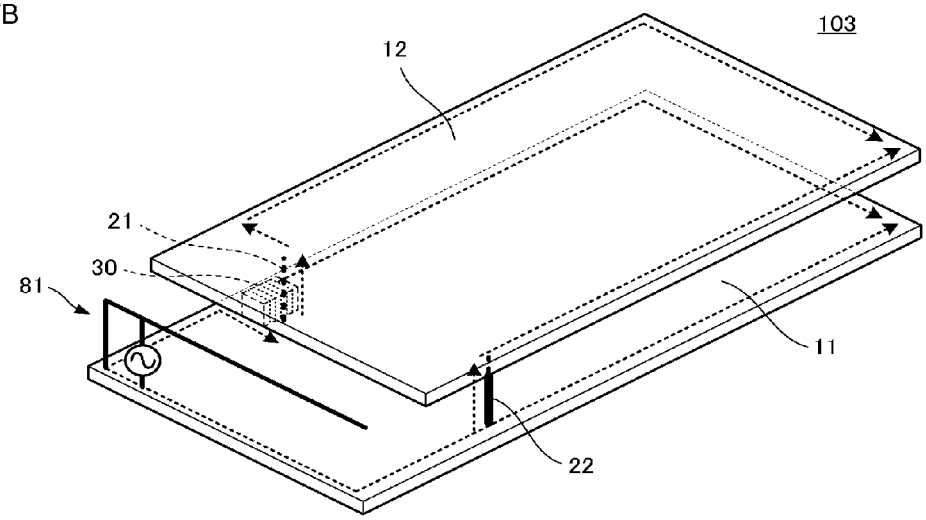
FIG. 7B is a perspective view of a portion of a communication terminal device including an antenna device in a comparative example.

FIG. 7A is a perspective view of a portion of a communication terminal device including an antenna device 103 according to a third preferred embodiment of the present invention. FIG. 7B is a perspective view of a portion of a communication terminal device including an antenna device in a comparative example. These communication terminal devices preferably are communication terminal devices each including an antenna 81 for the UHF band that is located in a circuit board. In the circuit board, a ground electrode that is the first conductor surface 11 is provided. In FIGS. 7A and 7B, the antenna 81 is an inverted-F antenna, but is schematically illustrated in the figures by using a conductor line.

The antenna 81 for the UHF band is preferably used for calls and data communications by a mobile phone.

In the antenna device 103 in the present preferred embodiment illustrated in FIG. 7A, the first connecting conductor 21 is located inward of the edges of the first conductor surface 11 and the second conductor surface 12. The other connecting conductors 22 and 25 are located at the edges of the first conductor surface 11 and the second conductor surface 12. The connecting conductor 25 causes conduction between a land 25L and the second conductor surface 12. A chip capacitor 5 is mounted between the land 25L and the first conductor surface 11. In other words, a portion that is the connecting conductor 25 connects the first conductor surface 11 and the second conductor surface 12 with the chip capacitor 5 located in between. The chip capacitor 5 is an element that has a high impedance in a frequency band of communication signal carrier frequencies (HF band) but that has a low impedance at a frequency equal to or higher than frequencies in the UHF band. In other words, it is difficult to make the chip capacitor 5 conductive in the HF band, but easy to make it conductive in the UHF band.

In an antenna device in a comparative example illustrated in FIG. 7B, the first connecting conductor 21 and the second connecting conductor 22 are located at edges of the first conductor surface 11 and the second conductor surface 12.

The antenna 81 for the UHF band causes currents to flow through the first conductor surface 11 and the second conductor surface 12. Broken-line arrows in the figures represent current paths. Basically, a substrate current flows through the first conductor surface 11 (ground electrode in the circuit board), while an enclosure current flows through the second conductor surface 12 (a metal portion of the enclosure). The substrate current and the enclosure current flow through the connecting conductors 21 and 22, and the like.

Since the antenna coil 30 is located at the edge of the first conductor surface 11 in the antenna device in the comparative example illustrated in FIG. 7B, the substrate current from the antenna 81 for the UHF band influences the ferrite material of the antenna coil 30. As a result, the ferrite material causes a loss, and thus characteristics of the UHF-band antenna 81 are deteriorated.

In contrast, in the antenna device 103 in the present preferred embodiment illustrated in FIG. 7A, the antenna coil 30 is located inward of the edge of the first conductor surface 11. Accordingly, the substrate current from the antenna 81 for the UHF band does not pass through the connecting conductor 21 but passes through the chip capacitor 5 and the connecting conductor (the chip capacitor 5 is easy to make conductive in the UHF band). Specifically, the substrate current from the antenna 81 for the UHF band has almost no influence on the ferrite material of the antenna coil 30. For this reason, the characteristics of the antenna 81 for the UHF band are maintained. In addition, the chip capacitor 5 has a high impedance in the HF band, and thus a loop defined by the two conductor surfaces 11 and 12 and the two connecting conductors 21 and 25 is not a closed loop but an open loop. In other words, even if the antenna coil 30 is located inward of the edges of the two conductor surfaces 11 and 12, instead of at the edges, the two conductor surfaces 11 and 12 and the two connecting conductors 21 and 22 define a closed loop. Thus, the components included in the closed loop define and function as a booster antenna of the HF-band antenna.

Fourth Preferred Embodiment

Figure 8:
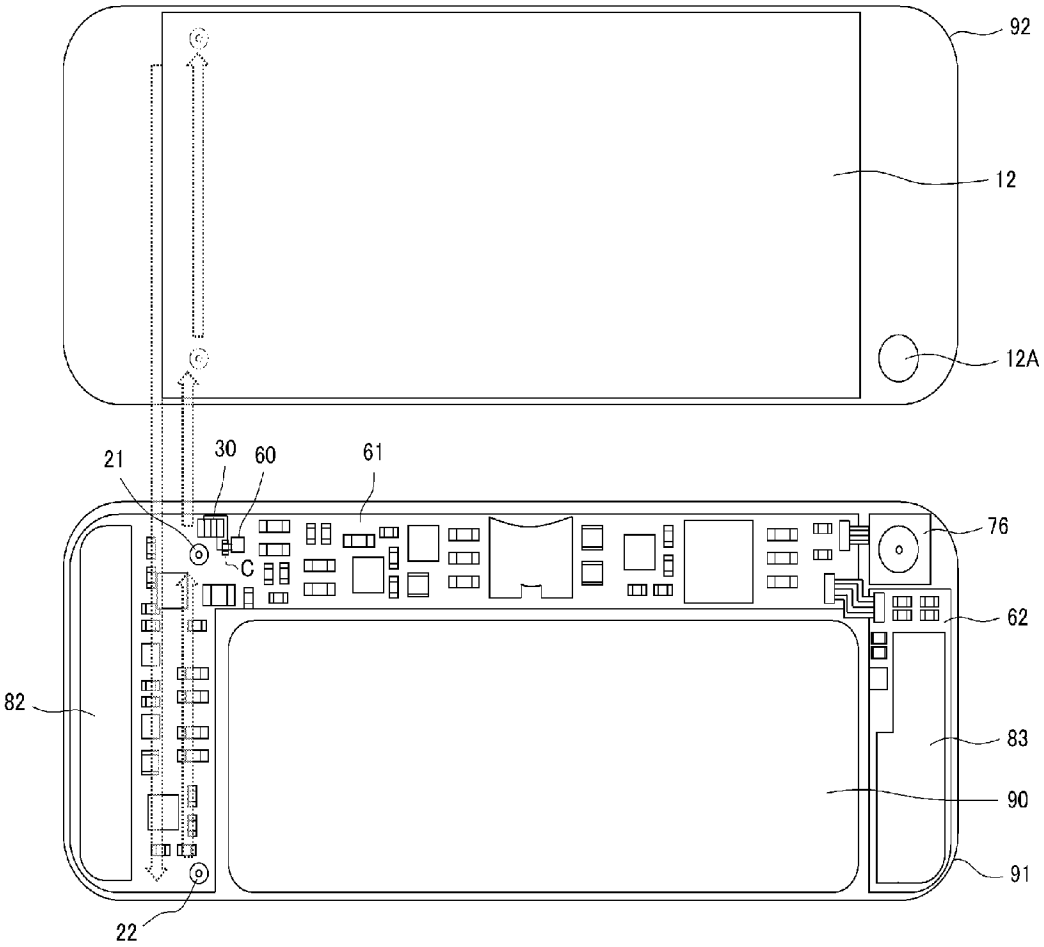
FIG. 8 is a plan view illustrating a configuration of components in an enclosure of a communication terminal device according to a fourth preferred embodiment of the present invention.

FIG. 8 is a plan view illustrating a configuration of components in an enclosure of a communication terminal device according to a fourth preferred embodiment of the present invention. An upper enclosure 91 accommodates circuit boards 61 and 62, a battery pack 90, a camera module 76, and the like. An RFIC 60 including a communication circuit, the resonant capacitor C, the antenna coil 30, and the like are mounted on the circuit board 61. This circuit board 61 is also provided with a main UHF-band antenna 82 and the like. The circuit board is provided with a sub UHF-band antenna 83 and the like. Circuits in the circuit board 61 and circuits in the circuit board 62 are connected to each other through cables. The UHF-band antennas 82 and 83 are provided by mounting chip antennas or by providing wiring patterns, for example.

The ground electrode is provided in almost an entire region of the circuit board 61, and the ground electrode thus defines and functions as a first conductor surface. A lower enclosure 92 is made of a resin, but the second conductor surface 12 made of a metal film is provided on an inner surface of the lower enclosure 92. The metal film may be formed by attaching an aluminum foil or a copper foil to the inner side of the lower enclosure 92 or by drawing a pattern on the inner side of the lower enclosure 92 by using an LDS technique or other techniques, for example. In addition, the metal film preferably occupies an area that is equal to or larger than a half of a main surface of the circuit board 61 in order to also define and function as a shield for various components mounted on the circuit board 61. In the present preferred embodiment, almost an entire region, except regions occupied by the main antenna 82 and the sub antenna 83, is shielded by the metal film. An opening 12A is provided in the lower enclosure 92. A lens of a camera module 76 is arranged in this portion so as to be optically exposed.

The first connecting conductor 21 and the second connecting conductor 22 are mounted on the circuit board 61.

Figure 9:
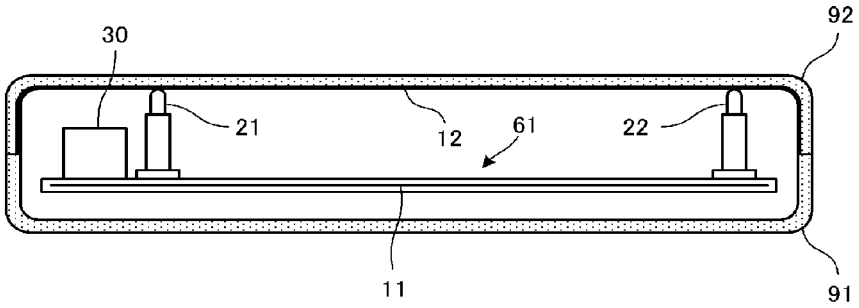
FIG. 9 is a cross-sectional view of the communication terminal device taken along a line passing through positions of a first connecting conductor 21 and a second connecting conductor 22.

FIG. 9 is a cross-sectional view taken along a line passing through positions of the first connecting conductor 21 and the second connecting conductor 22. In the same manner as in the antenna device illustrated in FIG. 1A in the first preferred embodiment, currents flow through the first conductor surface (ground electrode) 11 and the second conductor surface (metal portion of the enclosure) 12. In addition, a current flows through a closed loop defined by the two conductor surfaces 11 and 12 and the two connecting conductors 21 and 22. In this manner, the two conductor surfaces 11 and 12 define and function as a radiating element and a surface of a space in the closed loop defines and functions as a radiating element.

The preferred embodiments described above are provided for illustrative purposes, and the present invention is not limited to these preferred embodiments. The antenna coil 30 and the RFIC 60 may be integrated into one body as a module, for example. This configuration eliminates the need for wiring a substrate such as a circuit board to achieve electrical conduction between an RFIC and a power supply coil, and enhances the degree of freedom of a mounting space.

Note that as illustrated in FIG. 9, the antenna coil 30 preferably is mounted on the circuit board 61 in a portion above the first conductor surface (ground electrode) 11 provided in the circuit board 61 in the present preferred embodiment, but the antenna coil 30 is preferably mounted on the circuit board in a portion in which the first conductor surface (ground electrode) 11 has not been provided.

Figure 10:
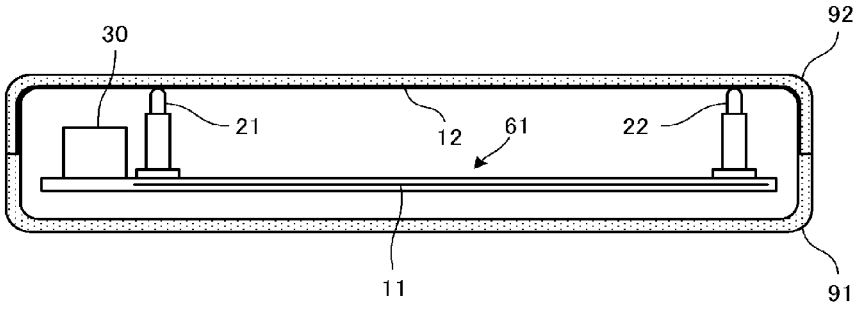
FIG. 10 is a cross-sectional view of another communication terminal device taken along a line passing through positions of the first connecting conductor 21 and the second connecting conductor 22.

FIG. 10 is a cross-sectional view taken along a line passing through positions of the first connecting conductor 21 and the second connecting conductor 22 of a communication terminal device other than the communication terminal device in FIG. 9, and is almost the same as the communication terminal device illustrated in FIG. 9, except that the antenna coil 30 is mounted on the circuit board 61 in a portion in which the first conductor surface (ground electrode) 11 has not been provided. With this configuration, the first conductor surface (ground electrode) 11 does not hinder the magnetic field generated from the antenna coil 30, and certain antenna characteristics are achieved.

In addition, the present invention is not limited to the configuration in which one of the first conductor surface and the second conductor surface according to the present invention is the ground electrode provided in the circuit board. The present invention is also not limited to the configuration in which one of the first conductor surface and the second conductor surface according to the present invention is the metal portion of the enclosure. For example, a shielding case, a shielding plate, a battery pack, an LCD panel, or the like may be utilized as the first conductor surface or the second conductor surface.

Moreover, FIG. 1A and other figures illustrate the first conductor surface 11 and the second conductor surface 12 that include a flat surface, but the shape of the second conductor surface 12 is not limited thereto. The second conductor surface may be the metal portion of the enclosure that accommodates the circuit board. Further, the metal portion of the enclosure may be formed by molding a metal plate, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

two conductor surfaces facing each other and spaced apart from each other;

a plurality of connecting conductors that connect the two conductor surfaces at at least two positions; and an antenna coil located in proximity to one connecting conductor of the plurality of connecting conductors; wherein two of the plurality of connecting conductors and the two conductor surfaces define a closed loop containing a surface of a space;

in a plan view of the surface of the space defined by the closed loop, the antenna coil is located at a position where the antenna coil does not overlap the surface of the space and is outside of the closed loop; and the antenna coil is located in proximity to the one connecting conductor at a position that is closer to the one connecting conductor than to remaining ones of the plurality of connecting conductors where electromagnetic induction by the antenna coil causes an induced current to flow through the one connecting conductor.

2. The antenna device according to claim 1, wherein the plurality of connecting conductors include three or more connecting conductors; and in plan views of surfaces of spaces in a plurality of loops defined by two adjacent connecting conductors of the plurality of connecting conductors and the two conductor surfaces, the antenna coil is located at a position where the antenna coil does not overlap any one of the surfaces of the spaces.

3. The antenna device according to claim 1, wherein the conductor surfaces include a conductor portion of an enclosure of an electronic device.

4. The antenna device according to claim 1, wherein the conductor surfaces include a ground electrode provided in a circuit board.

5. The antenna device according to claim 1, wherein the conductor surfaces include a ground electrode provided in a circuit board and a conductor portion of an enclosure of an electronic device, and the plurality of connecting conductors are ground connecting pins that connect the ground electrode and the conductor portion of the enclosure.

6. The antenna device according to claim 5, wherein any one of the plurality of connecting conductors that does not define the closed loop and the conductor surfaces are connected to one another through a capacitor;

a carrier frequency of a communication signal is a frequency in a HF band, and the capacitor is an element having a lower impedance at a frequency equal to or higher than a UHF band, than at a frequency in the HF band.

7. The antenna device according to claim 1, wherein the two conductor surfaces and the plurality of connecting conductors define a booster antenna.

8. The antenna device according to claim 1, wherein one of the plurality of connecting conductors is located inward of edges of the two conductor surfaces and others of the plurality of connecting conductors are located at the edges of the two conductor surfaces.

9. A communication terminal device comprising:

an antenna device; and a power supply circuit connected to the antenna device; wherein the antenna device includes:

two conductor surfaces facing each other and spaced apart from each other;

a plurality of connecting conductors that connect the two conductor surfaces at at least two positions; and an antenna coil located in proximity to one connecting conductor of the plurality of connecting conductors; wherein two of the plurality of connecting conductors and the two conductor surfaces define a closed loop containing a surface of a space;

in a plan view of the surface of the space defined by the closed loop, the antenna coil is located at a position where the antenna coil does not overlap the surface of the space and is outside of the closed loop;

the antenna coil is located in proximity to the one connecting conductor at a position that is closer to the one connecting conductor than to remaining ones of the plurality of connecting conductors where electromagnetic induction by the antenna coil causes an induced current to flow through the one connecting conductor.

10. The communication terminal device according to claim 9, wherein the plurality of connecting conductors include three or more connecting conductors; and in plan views of surfaces of spaces in a plurality of loops defined by two adjacent connecting conductors of the plurality of connecting conductors and the two conductor surfaces, the antenna coil is located at a position where the antenna coil does not overlap any one of the surfaces of the spaces.

11. The communication terminal device according to claim 9, wherein the conductor surfaces include a conductor portion of an enclosure of an electronic device.

12. The communication terminal device according to claim 9, wherein the conductor surfaces include a ground electrode provided in a circuit board.

13. The communication terminal device according to claim 9, wherein the conductor surfaces include a ground electrode provided in a circuit board and a conductor portion of an enclosure of an electronic device, and the plurality of connecting conductors are ground connecting pins that connect the ground electrode and the conductor portion of the enclosure.

14. The communication terminal device according to claim 13, wherein any one of the plurality of connecting conductors that does not define the closed loop and the conductor surfaces are connected to one another through a capacitor;

a carrier frequency of a communication signal is a frequency in a HF band, and the capacitor is an element having a lower impedance at a frequency equal to or higher than a UHF band, than at a frequency in the HF band.

15. The communication terminal device according to claim 9, wherein the two conductor surfaces and the plurality of connecting conductors define a booster antenna.

16. The communication terminal device according to claim 9, wherein one of the plurality of connecting conductors is located inward of edges of the two conductor surfaces and others of the plurality of connecting conductors are located at the edges of the two conductor surfaces.

17. The communication terminal device according to claim 9, further comprising circuit boards and a camera module.

18. The communication terminal device according to claim 17, wherein one of the circuit boards includes an RFIC mounted thereon.

19. The communication terminal device according to claim 17, wherein one of the circuit boards includes a ground electrode disposed on almost an entire surface thereof, and the ground electrode defines one of the two conductor surfaces.

20. The communication terminal device according to claim 17, wherein the antenna coil is mounted on a first of the circuit boards at a location above one of the two conductor surfaces or an area where the first of the circuit boards is not provided.

* * * * *